US012426692B2

(12) United States Patent
Tu

(10) Patent No.: US 12,426,692 B2
(45) Date of Patent: Sep. 30, 2025

(54) CLAMP WITH ELASTIC OPENING FUNCTION

(71) Applicant: TSORNG TA ENTERPRISE CO., LTD., Tainan (TW)

(72) Inventor: Chia-Yang Tu, Tainan (TW)

(73) Assignee: TSORNG TA ENTERPRISE CO., LTD., Tainan (TW)

( * ) Notice: Subject to any disclaimer, the term of this patent is extended or adjusted under 35 U.S.C. 154(b) by 456 days.

(21) Appl. No.: 17/964,843

(22) Filed: Oct. 12, 2022

(65) Prior Publication Data

US 2024/0122326 A1 Apr. 18, 2024

(51) Int. Cl.
*A45D 8/16* (2006.01)

(52) U.S. Cl.
CPC ..... *A45D 8/16* (2013.01)

(58) Field of Classification Search
CPC . A45D 6/14; A45D 6/145; A45D 8/20; A45D 8/22; A45D 8/24; A45D 8/28; A45D 8/30; D06F 55/02; Y10T 24/44538; Y10T 24/4447; A44B 9/18
See application file for complete search history.

(56) References Cited

U.S. PATENT DOCUMENTS 4,175,306 A * 11/1979 Bigelow ..... D06F 55/02 24/507
5,549,127 A * 8/1996 Chang ..... A45D 8/20 132/277
5,642,740 A * 7/1997 Chen ..... A45D 8/20 132/156
5,873,377 A * 2/1999 Yang ..... A45D 8/20 132/273
7,493,903 B2 * 2/2009 Rogers ..... A45D 8/22 132/277
D627,099 S * 11/2010 Tu ..... D28/40
7,827,999 B2 * 11/2010 Tu ..... A45D 8/20 132/277
7,984,720 B2 * 7/2011 Tu ..... A45D 8/16 132/277
2003/0196675 A1 * 10/2003 Chang ..... A45D 8/20 132/277
2004/0154633 A1 * 8/2004 Rogers ..... A45D 8/20 132/277
2004/0177860 A1 * 9/2004 Rogers ..... A45D 8/22 132/277

(Continued)

*Primary Examiner* — Rachel R Steitz
*Assistant Examiner* — Karim Asqiriba
(74) *Attorney, Agent, or Firm* — J.C. PATENTS

(57) ABSTRACT

A clamp with elastic opening function includes at least a first clamping body and a second clamping body. The first clamping body has a first clamping portion and a first axle seat, the second clamping body is has a second clamping portion and a second axle seat, the first clamping portion and second clamping portion are arranged in correspondence with each other. The first axle seat and second axle seat are pivotally connected to each other, so that the first clamping body and second clamping body can rotate relatively. The upper end of the first axle seat has a first pressing portion, and the lower end of the second axle seat has a second pressing portion, a spiral clutch device and an elastic telescopic torsion member are arranged between the first axle seat and second axle seat.

7 Claims, 11 Drawing Sheets

(56) References Cited

U.S. PATENT DOCUMENTS

| | | | | |
|---|---|---|---|---|
| 2004/0231692 | A1* | 11/2004 | Shyu | A45D 8/20 132/277 |
| 2012/0186602 | A1* | 7/2012 | Hsu | A45D 8/20 132/277 |
| 2020/0288837 | A1* | 9/2020 | Tu | A45D 8/22 |
| 2021/0022469 | A1* | 1/2021 | Freeman | A45D 8/20 |
| 2023/0363508 | A1* | 11/2023 | Freeman | A45D 8/20 |
| 2024/0049857 | A1* | 2/2024 | Glucksman | A45D 4/16 |
| 2024/0081503 | A1* | 3/2024 | Jenkins | A45D 8/20 |
| 2024/0365944 | A1* | 11/2024 | Hsu | A45D 8/20 |
| 2024/0374009 | A1* | 11/2024 | Hsu | A45D 8/20 |

* cited by examiner

CLAMP WITH ELASTIC OPENING FUNCTION

BACKGROUND OF THE INVENTION

1. Field of the Invention

This invention relates to a clamp, particularly to a clamp that can be applied to various items such as hair, thread and plants that need to be repeatedly clamped and released.

2. Description of the Prior Art

Traditional clamps with elastic opening function, such as U.S. Pat. No. 7,984,720B2 "BOBBY PIN", which is composed of a left clip body 2 and a right clip body 3. The left clip body 2 and the right clip body 3 are respectively provided with a plurality of clip ribs 20, 30 and joint parts 21, 31, a shaft 6 is passed through the joint parts 21, 31 and the elastic members 4, 5 of the left clip body 2 and the right clip body 3, so that the bobby pin has the elastic opening function. Then, through the engaging teeth 200, 300 arranged on the clip ribs 20, 30 or the left ribs 201 and the right ribs 301 arranged on the left clip body 2 and the right clip body 3 to allows the user to achieve the multistage buckling effect by pressing the left clip body 2 and the right clip body 3.

However, after years of research, development, manufacturing and market research, the inventor found that there are many problems with the foregoing bobby pin that need to be overcome:

First, the engaging teeth 200, 300 of the bobby pin are not easy to be tightly engaged in use, and are very easy to loosen and elastically open, thus causing poor user experience. In addition, the engaging teeth 200, 300 of the clip ribs 20, 30 are very easy to clip the user's hair, which will not only damage the hair quality, but also cause the problem of the bobby pin being stuck.

Second, the left ribs 201 and the right ribs 301 are limited in size, so the number of the left ribs 201 and the right ribs 301 is limited, and there are very few adjustable levels, so it is very difficult for the user to finely adjust the tightness. And because the left ribs 201 and the right ribs 301 are small in size and quantity, their overall buckling force is relatively small, and they are very easy to be loosen and elastically open, resulting in reduced practicability of the bobby pin and poor market acceptance.

Third, the elastic members 4, 5 of the bobby pin are exposed to the outside, not only the appearance is not good, but the elastic members 4, 5 will also get dirty, get caught in the hair, and rust under the influence of external environmental factors (such as hair, water, hairspray and other pollutants).

Fourth, the structure of the bobby pin has many problems in mold manufacturing, and must be processed and manufactured in a very complex way, resulting in increased cost, higher price than other hairpins on the market, and loss of market competitiveness.

Therefore, the inventor having much experience in designing and manufacturing various clamps and its related products, understands and researches the problem of the foregoing bobby pin and hence devised this invention.

SUMMARY OF THE INVENTION

The objective of this invention is to offer an innovative clamp with elastic opening function, which the pivot position between the first clamping body and the second clamping body of the clamp is provided with a spiral clutch device and an elastic telescopic torsion member. The user can gradually close the clamp by pressing the first clamping body and the second clamping body, and by pressing the upper and lower ends of the pivot position of the first clamping body and the second clamping body, the clamp can be opened automatically.

Furthermore, the spiral clutch device of the present invention can effectively prevent the problem that the clamp is automatically opened due to clutch device slippage; the tighter the clamp is, the more parts of the spiral clutch device are engaged, and the greater the resistance to reverse movement is, in this way, the spiral clutch device can have the best meshing force and the effect of preventing clutch device slippage.

In addition, the elastic telescopic torsion member of the present invention will not be exposed to the outside, and has the functions of beautiful appearance and protection of the elastic telescopic torsion member. The clamp of the present invention has many ways of assembling and changing, better expansion function, easier manufacturing, higher manufacturing yield, and more exquisiteness. The shape design and material selection of the outer surface of the clamp will not be subject to any restrictions, and it has the best practicability and economic benefits.

The clamp with elastic opening function in the present invention includes at least a clamp, which is provided with a first clamping body and a second clamping body. Said first clamping body is provided with a first clamping portion and a first axle seat, said second clamping body is provided with a second clamping portion and a second axle seat, and said first clamping portion and second clamping portion are disposed corresponding to each other. Said first axle seat and second axle seat are pivotally connected to each other through a shaft, so that said first clamping body and second clamping body can rotate relative to each other. A first pressing portion is provided on the upper end of said first axle seat, and a second pressing portion is provided on the lower end of said second axle seat, and a spiral clutch device and an elastic telescopic torsion member are arranged between said first axle seat and second axle seat. Said spiral clutch device is provided with a first spiral rack and a second spiral rack, said first spiral rack and the second spiral rack are respectively disposed on said first axle seat and second axle seat corresponding to each other, and mesh with each other. Said elastic telescopic torsion member is provided with an elastic torsion portion and an elastic telescopic portion, two ends of said elastic torsion portion are respectively connected to said first clamping body and second clamping body to provide the elastic force for said first clamping body and second clamping body to be automatically opened. The upper and lower ends of said elastic telescopic portion are respectively abutted against said first axle seat and second axle seat to utilize the elastic force of said elastic telescopic portion to provide the meshing force between said first spiral rack and the second spiral rack.

The clamp with elastic opening function in the present invention, amount which said clamp is provided with a protective sleeve. Said protective sleeve is provided with a male sleeve and a female sleeve, a abutting portion is arranged on one side of said female sleeve, said male sleeve is arranged on one side of the second spiral rack of said second axle seat, and said female sleeve is covered on said male sleeve. Said female sleeve is restricted between said second spiral rack and first pressing portion, the abutting portion of said female sleeve abuts against the inner side wall of the first axle seat and can rotate synchronously with said first axle seat. A first buckle groove is arranged inside said female sleeve, and a second buckle groove is arranged inside said male sleeve. In this way, two ends of said elastic torsion portion can be fixed in the first buckle groove of said female sleeve and the second buckle groove of said male sleeve, respectively. Said elastic telescopic torsion member is wrapped in said protective sleeve and isolated from the outside.

The clamp with elastic opening function in the present invention, amount which said first axle seat may be provided with a first buckle groove inside said first pressing portion, and said second axle seat may be provided with a second buckle groove on one side of said second spiral rack. In this way, the two ends of the elastic torsion portion of said elastic telescopic torsion member can be inserted into said first buckle groove and second buckle groove respectively, and said elastic telescopic torsion member can be positioned between said first pressing portion and second spiral rack.

BRIEF DESCRIPTION OF DRAWINGS

This invention will be better understood by referring to the accompanying drawings, wherein.

Figure 1:
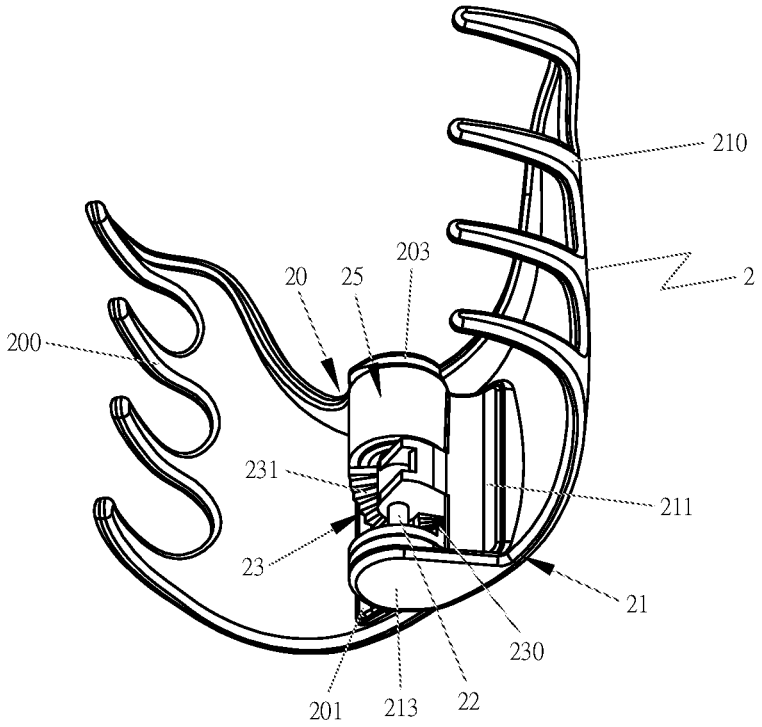
FIG. 1 is a perspective view of a first embodiment of the present invention.
Figure 2:
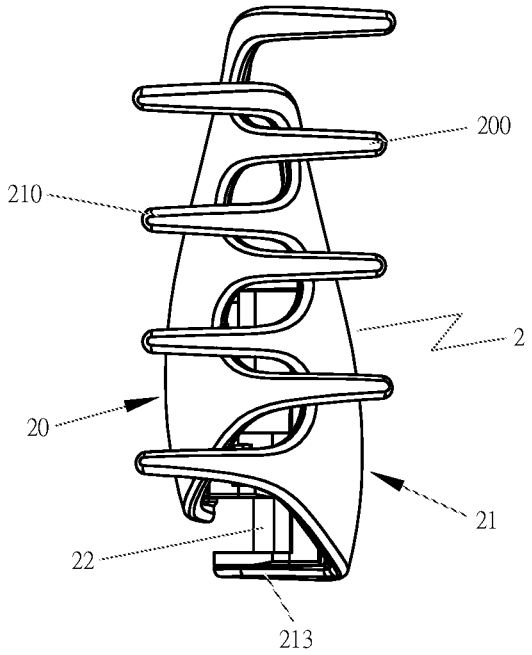
FIG. 2 is a front view of FIG. 1 clamped state.

2 clamp; 20 first clamping body; 200 first clamping portion; 201 first axle seat; 202 first connecting member; 203 first pressing portion; 204 first stopper; 205 first buckle groove; 21 second clamping body; 210 second clamping portion; 211 second axle seat; 212 second connecting member; 213 second pressing portion; 214 second stopper; 215 second buckle groove; 22 shaft; 23 spiral clutch device; 230 first spiral rack; 231 second spiral rack; 24 elastic telescopic torsion member; 240 elastic torsion portion; 241 elastic telescopic portion; protective sleeve; 250 male sleeve; 251 female sleeve; 252 abutting portion; 26 cover; 27 decorative structure.

DETAILED DESCRIPTION OF THE PREFERRED EMBODIMENT

The preferred embodiments of the clamp with elastic opening function in the present invention, as shown in FIGS. 1 to 19 includes at least:

A clamp 2 is provided with a first clamping body 20 and a second clamping body 21, said first clamping body 20 is provided with a first clamping portion 200 and a first axle seat 201, said second clamping body 21 is provided with a second clamping portion 210 and a second axle seat 211, and said first clamping portion 200 and second clamping portion 210 are disposed corresponding to each other, so as to jointly clamp an article. Said first axle seat 201 and second axle seat 211 are pivotally connected to each other through a shaft 22, so that said first clamping body 20 and second clamping body 21 can rotate relative to each other.

Figure 12:
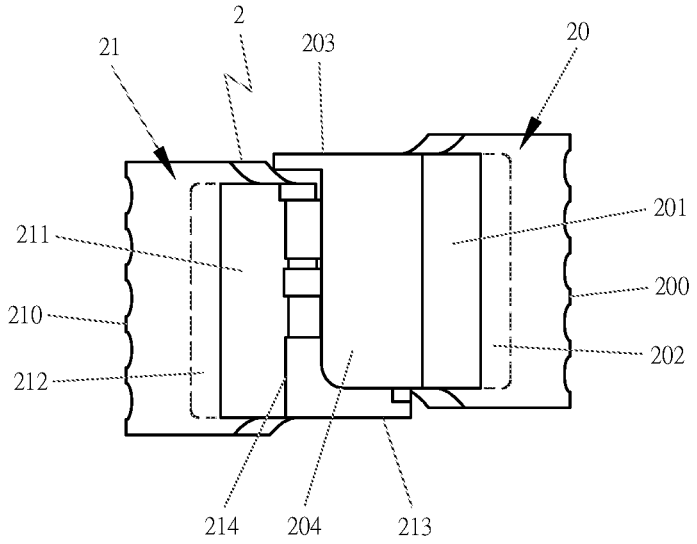
FIG. 12 is a schematic diagram of the tooth plate clamp structure of the first clamping portion and the second clamping portion of the present invention.
Figure 13:
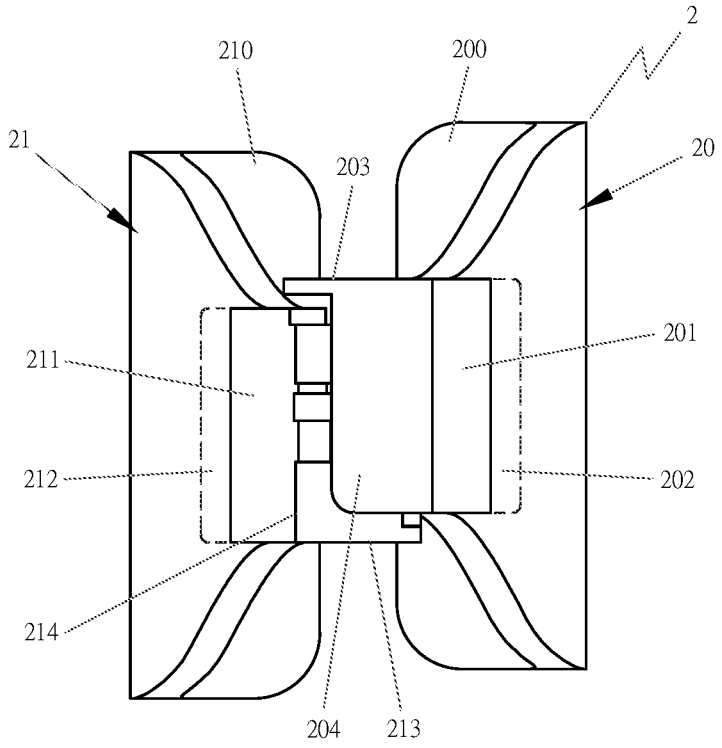
FIG. 13 is a schematic diagram of the ring clamp structure of the first clamping portion and the second clamping portion of the present invention.
Figure 14:
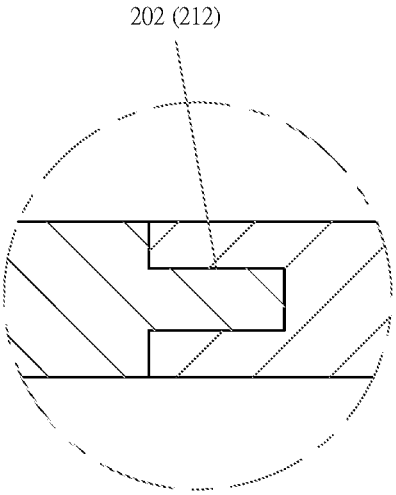
FIG. 14 is a first embodiment of the first connecting member and the second connecting member of the present invention.
Figure 15:
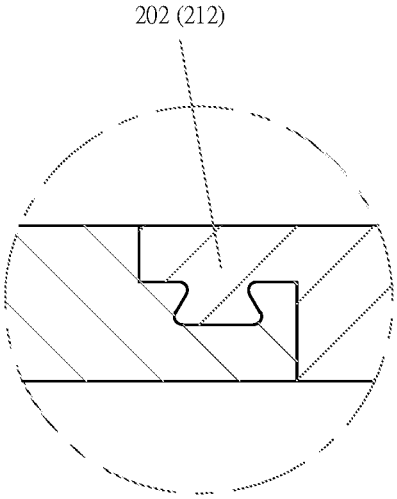
FIG. 15 is a second embodiment of the first connecting member and the second connecting member of the present invention.
Figure 16:
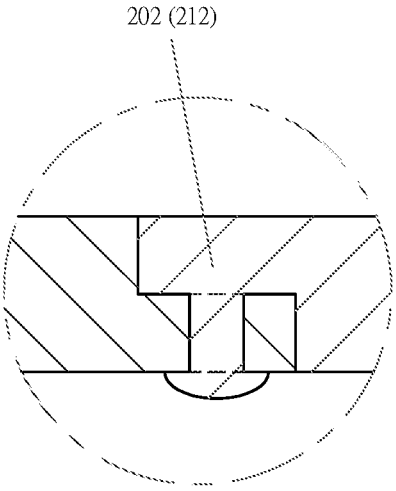
FIG. 16 is a third embodiment of the first connecting member and the second connecting member of the present invention.
Figure 17:
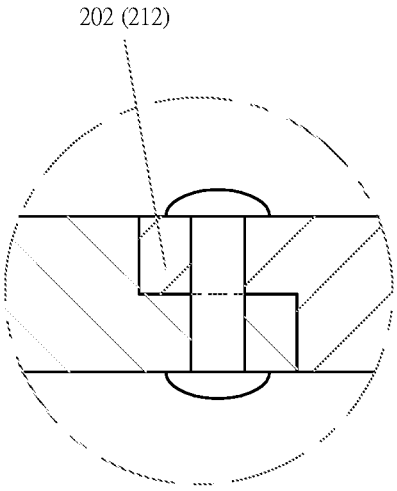
FIG. 17 is a fourth embodiment of the first connecting member and the second connecting member of the present invention.
Figure 18:
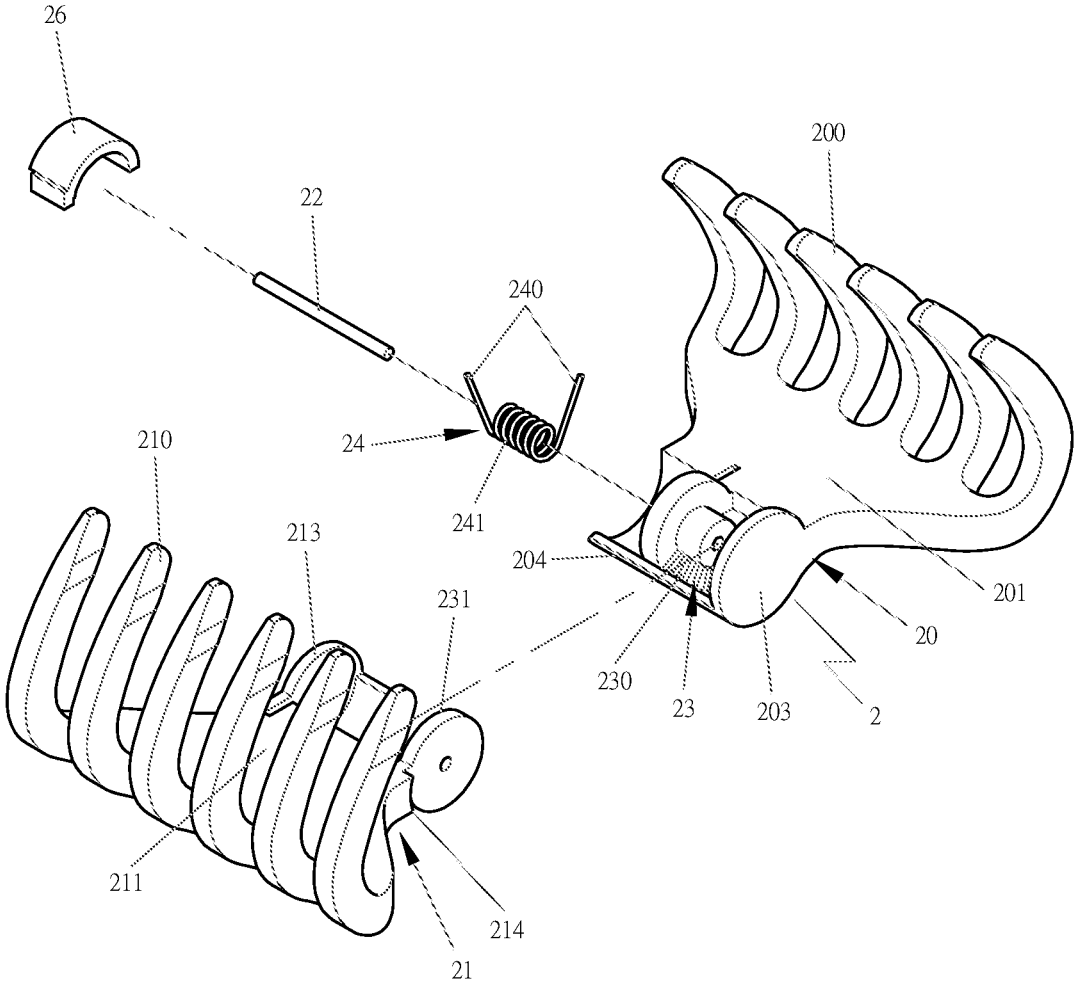
FIG. 18 is an exploded view of a third embodiment of the present invention.

Said first clamping portion 200 and second clamping portion 210 can be various structures such as a claw clamp structure (as shown in FIG. 1), a tooth plate clamp structure (as shown in FIG. 12), and a ring clamp structure (as shown in FIG. 13). Said first clamping body 20 and first clamping portion 200 can be integrally formed (as shown in FIG. 18); or can be an assembled structure, which a first connecting member 202 is arranged between said first clamping body 20 and first clamping portion 200. Said second clamping body 21 and second clamping portion 210 can be integrally formed (as shown in FIG. 18); or can be an assembled structure, which a second connecting member 212 is arranged between said second clamping body 21 and second clamping portion 210. Said first connecting member 202 and second connecting member 212 can be various replaceable structures such as an embedded structure or a snap-fitting structure (as shown in FIGS. 14 to 17), or can be a glue, depending on usage requirements.

Said first clamping portion 200 and second clamping portion 210 may be made of various hard or elastic materials such as plastic, rubber, wood, ceramic, metal, etc., so that the applicable range of the clamp 2 can be improved by changing the material. For example, when said first clamping portion 200 and second clamping portion 210 are made of hard materials such as metal, ceramics or wood, which are hard and not easily damaged, the durability of the clamp can be improved and the clamp can have more shape changes; when said first clamping part 200 and second clamping part 210 are made of elastic materials such as plastic or rubber, the clamp can be used to clamp special objects such as body parts, various wires or plants, so as to achieve the effect of protecting objects.

A first pressing portion 203 is provided on the upper end of said first axle seat 201, and a second pressing portion 213 is provided on the lower end of said second axle seat 211. A spiral clutch device 23 and an elastic telescopic torsion member 24 are arranged between said first axle seat 201 and second axle seat 211. A first stopper 204 is provided on the outer end of said first axle seat 201, a second stopper 214 is provided on the outer end of said second axle seat 211. Said first stopper 204 and second stopper 214 abut against each other to limit the maximum opening angle when said first axle seat 201 and second axle seat 211 are rotated and elastically opened.

Said spiral clutch device 23 is provided with a first spiral rack 230 and a second spiral rack 231, said first spiral rack 230 and the second spiral rack 231 are respectively disposed on said first axle seat 201 and second axle seat 211 corresponding to each other, and mesh with each other.

Figure 3:
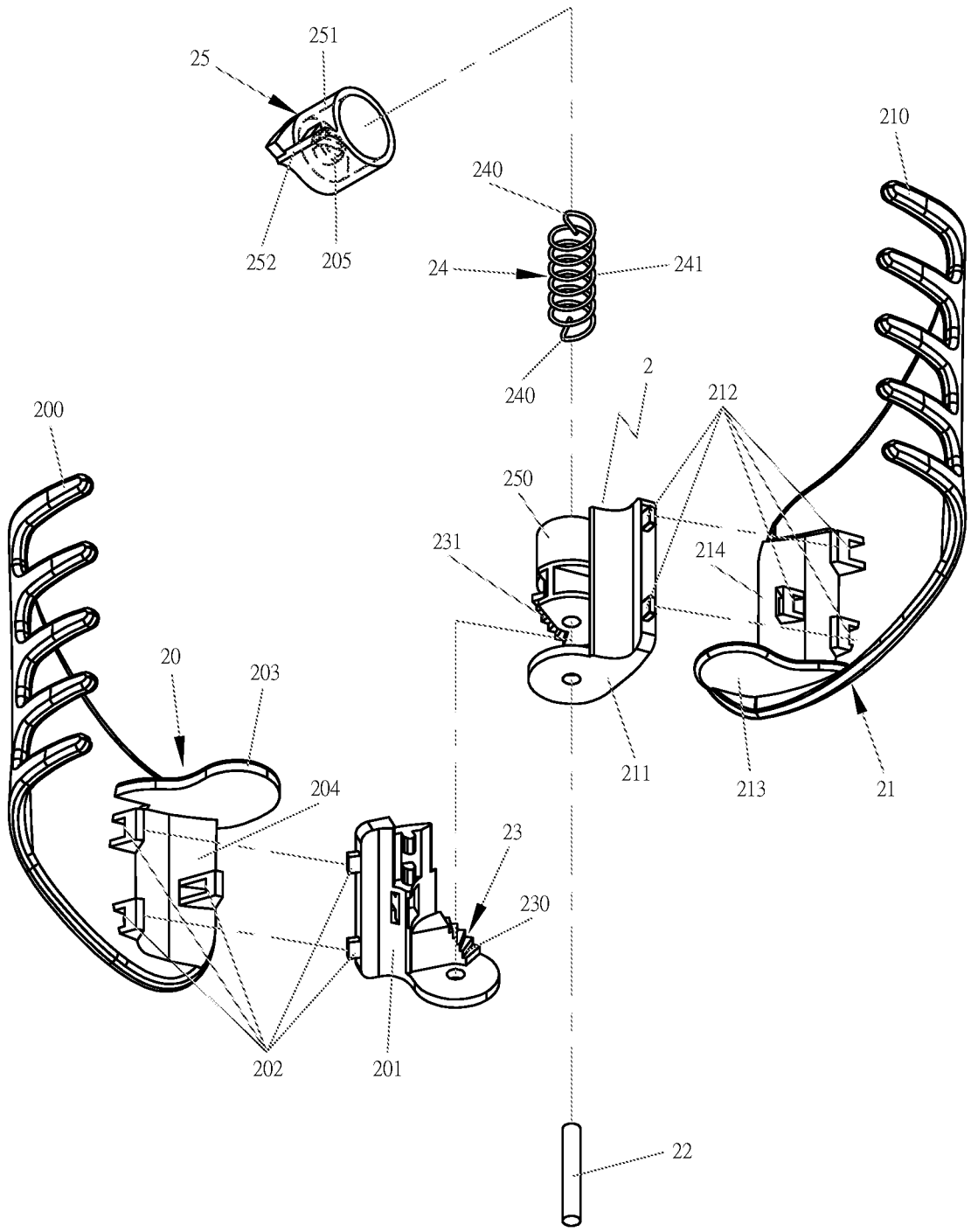
FIG. 3 is an exploded view of FIG. 1.
Figure 4:
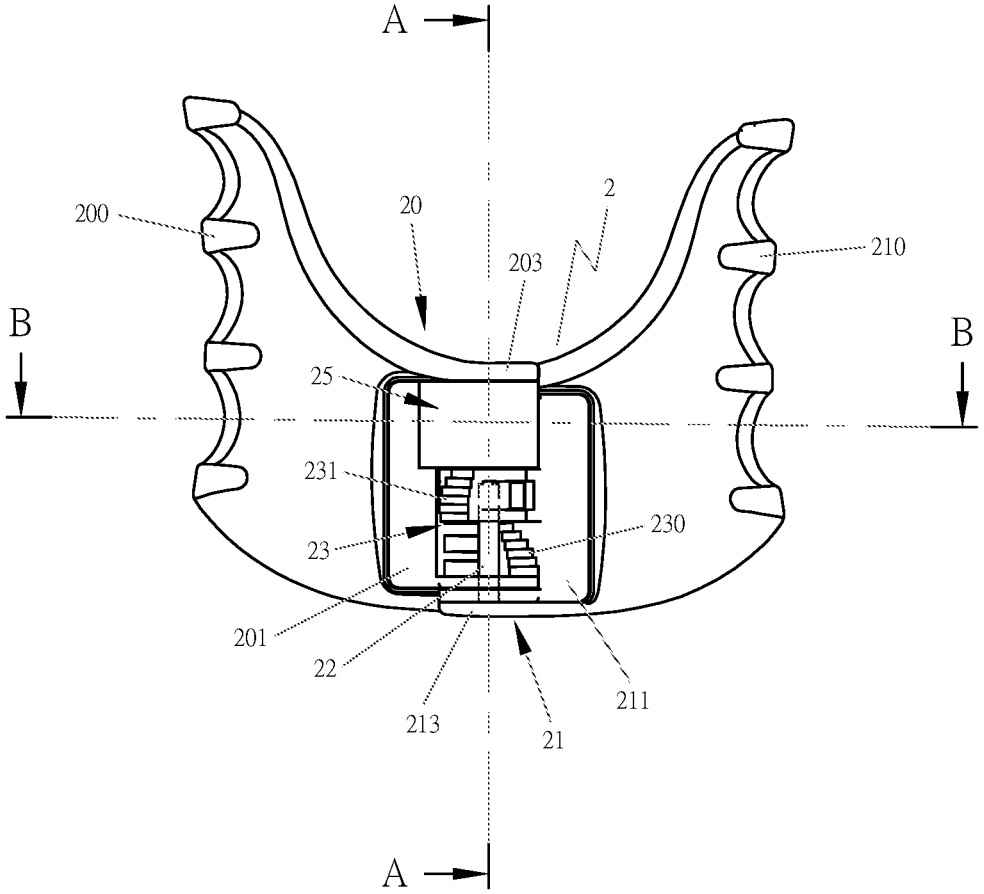
FIG. 4 is a front view of FIG. 1.
Figure 5:
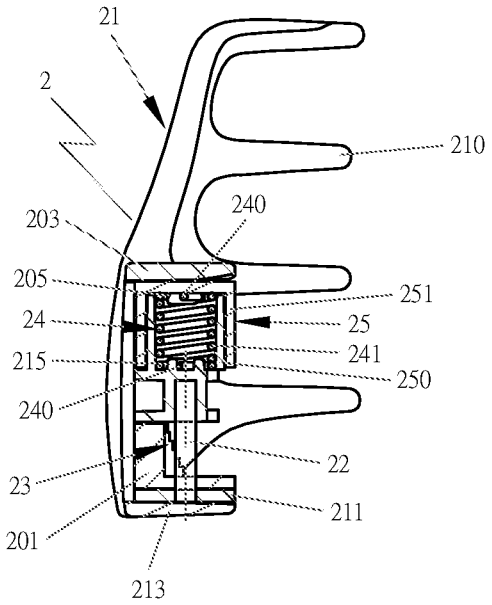
FIG. 5 is a cross-sectional view taken along A-A of FIG. 4.
Figure 6:
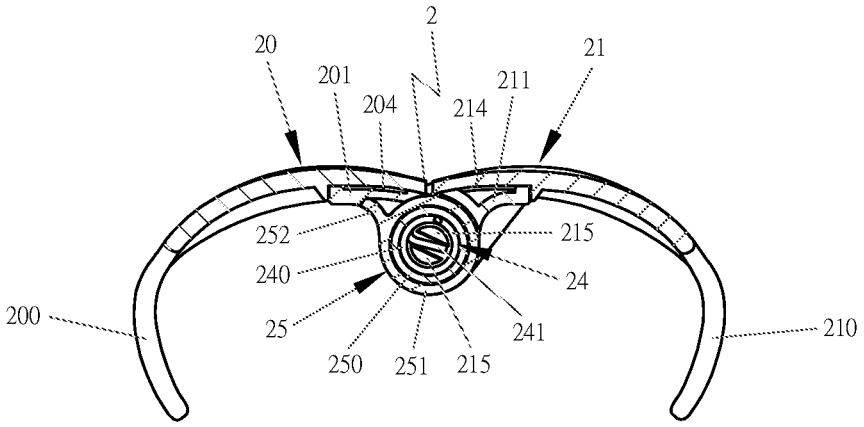
FIG. 6 is a cross-sectional view taken along line B-B of FIG. 4.
Figure 9:
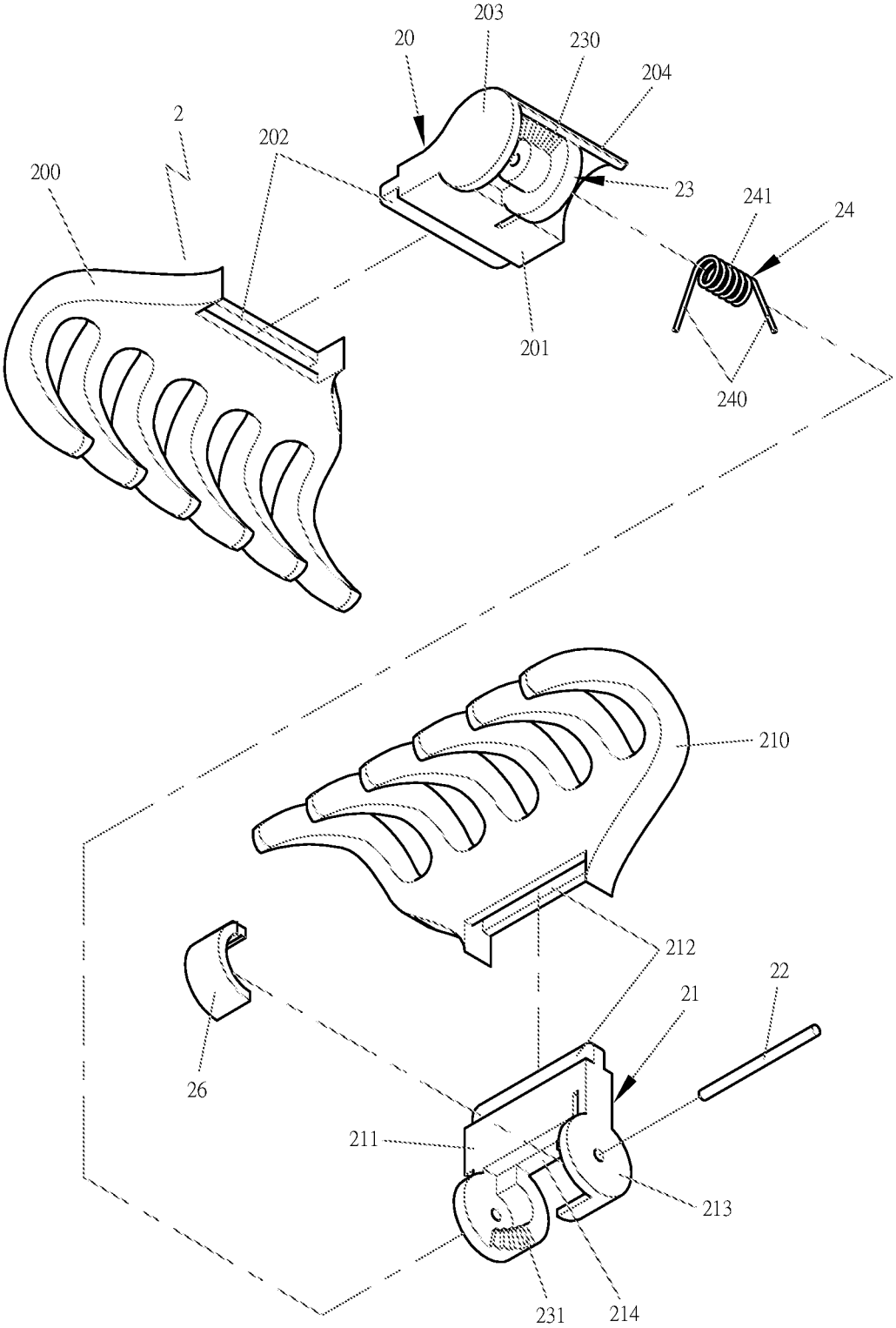
FIG. 9 is an exploded view of a second embodiment of the present invention.
Figure 10:
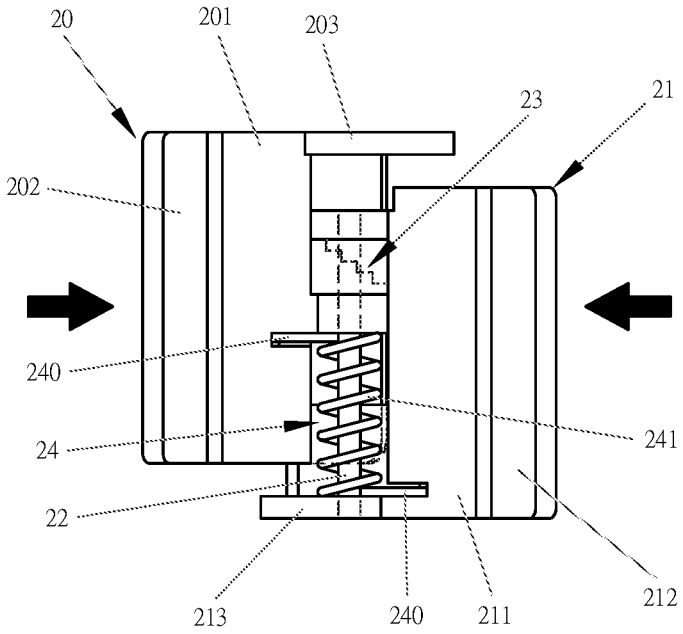
FIG. 10 is a schematic diagram of the clamping operation of the second embodiment of the present invention.
Figure 11:
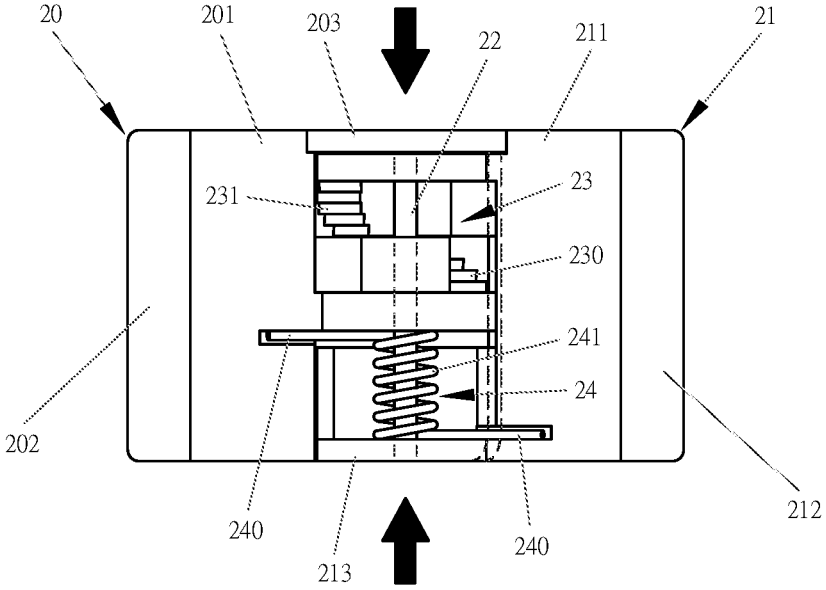
FIG. 11 is a schematic diagram of the opening operation of the second embodiment of the present invention.

Said elastic telescopic torsion member 24 is provided with an elastic torsion portion 240 and an elastic telescopic portion 241. Two ends of said elastic torsion portion 240 are respectively connected to said first clamping body 20 and second clamping body 21 to provide the elastic force for said first clamping body 20 and second clamping body 21 to be automatically opened. The upper and lower ends of said elastic telescopic portion 241 are respectively abutted against said first axle seat 201 and second axle seat 211 to utilize the elastic force of said elastic telescopic portion 241 to provide the meshing force between said first spiral rack 230 and the second spiral rack 231. As shown in FIGS. 3, 5 and 6, said first axle seat 201 may be provided with a first buckle groove 205 inside said first pressing portion 203, and said second axle seat 211 may be provided with a second buckle groove 215 on one side of said second spiral rack 231. In this way, the two ends of the elastic torsion portion 240 of said elastic telescopic torsion member 24 can be inserted into said first buckle groove 205 and second buckle groove 215 respectively, and said elastic telescopic torsion member 24 can be positioned between said first pressing portion 203 and second spiral rack 231. Or as shown in FIGS. 9 to 11, the two ends of said elastic torsion portion 240 can also abut against the inner sidewall surfaces of said first clamping body 20 and second clamping body 21 respectively.

Therefore, the elastic telescopic portion 241 of said elastic telescopic torsion member 24 can provide the binding force between said first spiral rack 230 and second spiral rack 231 to prevent said spiral clutch device 23 from slippage, and the user can press the clamp 2 very smoothly without the problem of jamming. When the user releases the clamp 2, the reaction force or elastic force generated by the clamped object will push the clamp in the opposite direction, the stepped structure of said spiral rack will generate a very strong anti-reverse movement resistance when subjected to the thrust of reverse movement (similar to the barb structure, and the anti-reverse movement resistance comes from the structural characteristics of said first spiral rack 230 and second spiral rack 231, and the elastic force of said elastic telescopic portion 241), preventing the spiral clutch device 23 from slippage and elastically opening. In addition, the tighter the clamp 2 is, the more teeth of rack are engaged, and the greater the anti-reverse movement resistance is, so that said spiral clutch device 23 can have the best meshing force and anti-slipping effect.

As shown in FIG. 3, the elastic torsion portion 240 and elastic telescopic portion 241 of said elastic telescopic torsion member 24 can be integrally formed (for example, elastic telescopic torsion spring), or can be two separate structures. When the elastic torsion portion 240 and elastic telescopic portion 241 of said elastic telescopic torsion member 24 are two separate structures, said elastic torsion portion 240 can be a torsion spring or an elastic piece, and said elastic telescopic portion 241 can be a telescopic spring or an elastic body (such as a plastic block or rubber block with elastic force, which can solve the problem of metal rusting).

As shown in FIGS. 1 to 8, it is the first embodiment of said clamp 2, which is provided with a protective sleeve 25. Said protective sleeve 25 is provided with a male sleeve 250 and a female sleeve 251, a abutting portion 252 is arranged on one side of said female sleeve 251, said male sleeve 250 is arranged on one side of the second spiral rack 231 of said second axle seat 211, and said female sleeve 251 is covered on said male sleeve 250. Said female sleeve 251 is restricted between said second spiral rack 231 and first pressing portion 203, the abutting portion 252 of said female sleeve 251 abuts against the inner side wall of the first axle seat 201 and can rotate synchronously with said first axle seat 201. A first buckle groove 205 is arranged inside said female sleeve 251, and a second buckle groove 215 is arranged inside said male sleeve 250. In this way, two ends of said elastic torsion portion 240 can be fixed in the first buckle groove 205 of said female sleeve 251 and the second buckle groove 215 of said male sleeve 250, respectively. Said elastic telescopic torsion member 24 is wrapped in said protective sleeve 25 and isolated from the outside, so as to reduce the influence of external factors such as hair, water, hair spray, etc. on said elastic telescopic torsion member 24, and achieve the effect of beauty and rust prevention.

As shown in FIG. 9, it is the second embodiment of said clamp 2; as shown in FIG. 18, it is the third embodiment of said clamp 2. Said clamp 2 is provided with a cover 26 on the outer side of said elastic telescopic torsion member 24, and said elastic telescopic torsion member 24 is covered in said cover 26, so as to reduce the influence of external factors such as hair, water, hair spray, etc. on said elastic telescopic torsion member 24, and achieve the effect of beauty and rust prevention.

Figure 19:
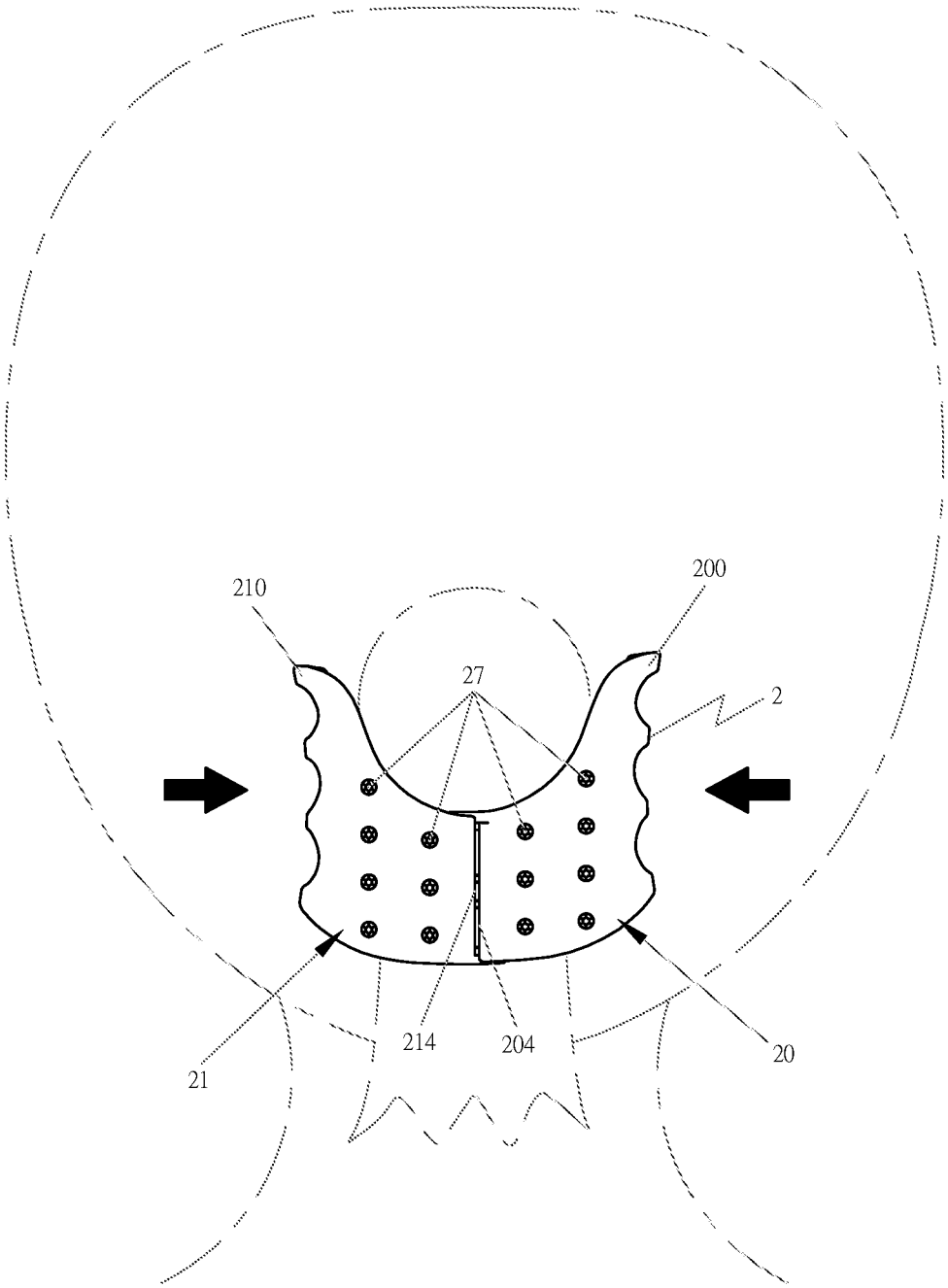
FIG. 19 is a schematic diagram of the use state of the clamp of the present invention.

As shown in FIG. 19, the outer surface of said clamp 2 may be provided with a decorative structure 27, such as rhinestones, embossed or printed matter, etc., said decorative structure 27 can be arranged at any position on the outer surface of said clamp 2, and can also be changed in various shapes.

Figure 7:
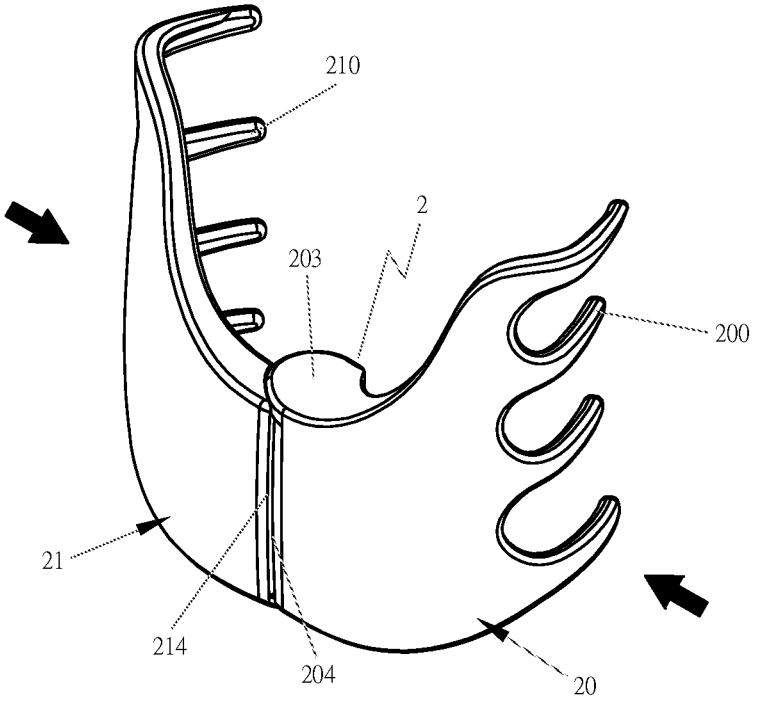
FIG. 7 is a schematic diagram of the clamping operation of the first embodiment of the present invention.

As shown in FIGS. 7 and 10, when the user places the clamp 2 on an item (as shown in FIG. 19), she only needs to press the two sides of the first clamping body 20 and second clamping body 21 of the clamp 2, the clamp 2 will be gradually rotated to clamp the item, and the user can control the degree of pressing and clamping according to her needs. At this time, the elastic torsion portion 240 of the elastic telescopic torsion member 24 will be compressed, the rebound force of the elastic telescopic portion 241 of the elastic telescopic torsion member 24 will automatically pressurize the spiral clutch device 23. So the first spiral rack 230 and the second spiral rack 231 can be can be meshed and positioned with each other, to prevent the clamp 2 from being opened by the reverse elastic force of the elastic torsion portion 240 of the elastic telescopic torsion member 24 and the reaction force of the object, and complete the clamping operation of the clamp 2.

Figure 8:
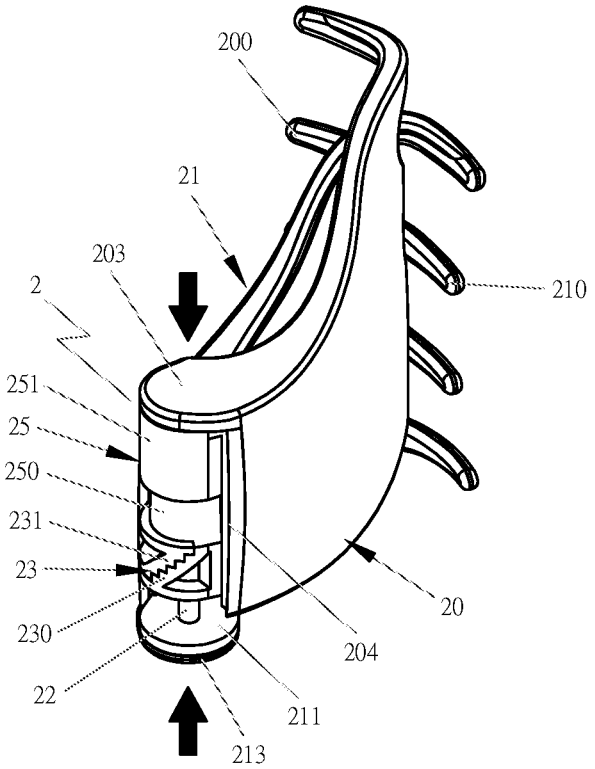
FIG. 8 is a schematic diagram of the opening operation of the first embodiment of the present invention.

As shown in FIGS. 8 and 11, when the user wants to remove the clamp 2, she only needs to press the first pressing portion 203 and the second pressing portion 213 of the clamp 2, and the first spiral rack 230 and the second spiral rack 231 of the spiral clutch device 23 will be separated from each other (slippage). At this time, the elastic telescopic portion 241 of the elastic telescopic torsion member 24 will be compressed, the reverse elastic force of the elastic torsion portion 240 of the elastic telescopic torsion member 24 will automatically open the first clamping body 20 and the second clamping body 21, and complete the opening operation of the clamp 2.

To sum up, the clamp with the elastic opening function of the present invention is very convenient to use, it can effectively prevent the problem that the clamp is automatically opened due to clutch device slippage; the tighter the clamp is, the more parts of the spiral clutch device are engaged, and the greater the resistance to reverse movement is, in this way, the spiral clutch device can have the best meshing force and the effect of preventing clutch device slippage. In addition, the elastic telescopic torsion member of the present invention will not be exposed to the outside, and has the functions of beautiful appearance and protection of the elastic telescopic torsion member. The clamp of the present invention has many ways of assembling and changing, better expansion function, easier manufacturing, higher manufacturing yield, and more exquisiteness. The shape design and material selection of the outer surface of the clamp will not be subject to any restrictions, and it has the best practicability and economic benefits.

While the preferred embodiments of this invention have been described above, it will be recognized and understood that various modifications may be made therein and appended claims are intended to cover all such modifications that may fall within the spirit and scope of the invention.

What is claimed is:

1. A clamp with elastic opening function at least comprising:

a clamp, is provided with a first clamping body and a second clamping body, said first clamping body is provided with a first clamping portion and a first axle seat, said second clamping body is provided with a second clamping portion and a second axle seat, and said first clamping portion and second clamping portion are disposed corresponding to each other; said first axle seat and second axle seat are pivotally connected to each other through a shaft, so that said first clamping body and second clamping body can rotate relative to each other; a first pressing portion is provided on an upper end of said first axle seat, and a second pressing portion is provided on a lower end of said second axle seat, and a spiral clutch device and an elastic telescopic torsion member are arranged between said first axle seat and second axle seat;

said spiral clutch device is provided with a first spiral rack and a second spiral rack, said first spiral rack and the second spiral rack are respectively disposed on said first axle seat and second axle seat corresponding to each other, and mesh with each other;

said elastic telescopic torsion member is provided with an elastic torsion portion and an elastic telescopic portion, two ends of said elastic torsion portion are respectively connected to said first clamping body and second clamping body to provide an elastic force for said first clamping body and second clamping body to be automatically opened; the upper and lower ends of said elastic telescopic portion are respectively abutted against said first axle seat and second axle seat to utilize the elastic force of said elastic telescopic portion to provide a meshing force between said first spiral rack and the second spiral rack.

2. The clamp with elastic opening function according to claim 1, wherein said clamp is provided with a protective sleeve; said protective sleeve is provided with a male sleeve and a female sleeve, an abutting portion is arranged on one side of said female sleeve, said male sleeve is arranged on one side of the second spiral rack of said second axle seat, said female sleeve is covered on said male sleeve, said female sleeve is restricted between said second spiral rack and first pressing portion, the abutting portion of said female sleeve abuts against an inner side wall of the first axle seat and rotates synchronously with said first axle seat; a first buckle groove is arranged inside said female sleeve, a second buckle groove is arranged inside said male sleeve, two ends of said elastic torsion portion are respectively fixed in the first buckle groove of said female sleeve and the second buckle groove of said male sleeve, and said elastic telescopic torsion member is wrapped in said protective sleeve.

3. The clamp with elastic opening function according to claim 1, wherein said clamp is provided with a cover on an outer side of said elastic telescopic torsion member, and said elastic telescopic torsion member is covered in said cover.

4. The clamp with elastic opening function according to claim 1, wherein said first axle seat is provided with a first buckle groove inside said first pressing portion, said second axle seat is provided with a second buckle groove on one side of said second spiral rack, the two ends of the elastic torsion portion of said elastic telescopic torsion member are inserted into said first buckle groove and second buckle groove respectively, and said elastic telescopic torsion member is positioned between said first pressing portion and second spiral rack.

5. The clamp with elastic opening function according to claim 1, wherein a first connecting member is arranged between said first clamping body and first clamping portion, and a second connecting member is arranged between said second clamping body and second clamping portion.

6. The clamp with elastic opening function according to claim 1, wherein a first stopper is provided on an outer end of said first axle seat, a second stopper is provided on an outer end of said second axle seat, said first stopper and second stopper abut against each other to limit the maximum opening angle when said first axle seat and second axle seat are rotated and elastically opened.

7. The clamp with elastic opening function according to claim 1, wherein the elastic torsion portion and elastic telescopic portion of said elastic telescopic torsion member are integrally formed.

* * * * *